US010780443B2

(12) United States Patent
Swensen

(10) Patent No.: US 10,780,443 B2
(45) Date of Patent: Sep. 22, 2020

(54) METHOD, SYSTEM AND APPARATUS FOR HARD CONTAMINATE SEPARATION FROM A PARTICULATE

(71) Applicant: Roger Swensen, Salt Lake City, UT (US)

(72) Inventor: Roger Swensen, Salt Lake City, UT (US)

( * ) Notice: Subject to any disclaimer, the term of this patent is extended or adjusted under 35 U.S.C. 154(b) by 181 days.

(21) Appl. No.: 15/592,995

(22) Filed: May 11, 2017

(65) Prior Publication Data

US 2018/0326428 A1 Nov. 15, 2018

(51) Int. Cl.
*B02C 23/14* (2006.01)
*B02C 19/06* (2006.01)
*B03C 7/00* (2006.01)

(52) U.S. Cl.
CPC ..... *B02C 23/14* (2013.01); *B02C 19/06* (2013.01); *B03C 7/00* (2013.01)

(58) Field of Classification Search
None
See application file for complete search history.

(56) References Cited

U.S. PATENT DOCUMENTS 4,538,764 A * 9/1985 Dunbar ..... B02C 19/065 241/39
8,177,149 B2 * 5/2012 Nied ..... B02C 19/065 241/19
9,555,416 B2 * 1/2017 Yoshikawa ..... B02C 19/066
2015/0083830 A1 * 3/2015 Leone ..... B02C 19/06 241/1
2016/0236203 A1 * 8/2016 Driver ..... B02C 23/08

* cited by examiner

*Primary Examiner* — Nina Bhat
(74) *Attorney, Agent, or Firm* — Steven Rinehart

(57) ABSTRACT

A system, apparatus and method for separating hard contaminates of a compound from softer elements using a milling process wherein particle size reduction if effectuated on the softer elements. The milled material is then subjected to particle separation devices to remove the larger particles thereby reducing the percentage of hard particles in the remaining compound. Additional milling and separation steps are used to hard material concentration to less than a predetermined threshold.

14 Claims, 5 Drawing Sheets

METHOD, SYSTEM AND APPARATUS FOR HARD CONTAMINATE SEPARATION FROM A PARTICULATE

BACKGROUND OF THE INVENTION

Field of the Invention

The present invention relates to a method for separating constituents of compounds that contain such constituents that have different inherent hardness aspects and based on those hardness differences milling such combined materials to very fine particle sizes.

Description of the Related Art

Materials such as petroleum coke often consist of various unwanted impurities or contaminates unsuitable for an intended use. Such materials include very hard materials or particulate that can cause destructive wear issues if introduced into certain usage systems such as reciprocating fuel combustion engines. These materials can be silica or aluminum oxide-based materials that have very abrasive characteristics especially in high flow rate or close tolerance systems. In such systems, it is beneficial to remove the highly abrasive components from the material before introduction.

Current art in the industry teaches no efficient way of separating hard material from particulate matter. Material in need of separation may consist of elements of a differing hardness which when milled to very fine levels can result in some portion of the particle size of some material more readily reduced in a jet mill particle reduction system. Such systems reduce particle size by directing particles to collide with each other. The harder material is more resilient to particle size reduction in the milling process while the softer material reduces size more rapidly. This differential in the size reduction rate provides an opportunity to selectively separate the material elements that could be difficult to physically separate otherwise, and provides an opportunity for curing an inefficiency in the art.

In the jet milling system, coarser particles are carried along in a fluid such as steam or pressurized air and introduced into a system that drives particles into Collision with one another, reducing the particles in size by such collisions. In such systems, the driving force providing energy for the particle size reduction is the fluid steam or air or other gas introduced to the system in such way as to provide velocity to the particles in the jet mill to create particle size reduction.

When the composite material subjected to the milling process is made up of components that have a differing hardness, the lighter materials are more readily reduced. The smaller elements can then be extracted by means of a product classification system either internal to the jet mill or the classification can take place after the jet milling system size reduction particle operation.

Existing component separation technologies involve either floatation-flocculation systems or other systems that use chemical conversion extraction systems using reactors to extract contaminates. Both of those systems involve high capital costs and materials subjected to them still post-separation micronization to reduce particle size to introduce any kind of processing to the technology for particle separation for the unwanted elements.

For the floatation separation systems, the elements of the compound that are to be separated need to be separated by means of floatation separation based on high density. Higher density materials and materials that may be hydrophobic can be separated from those that are not. This separation process can involve expensive capital costs for floatation and still require particles size reduction systems to expose the unwanted elements to separation techniques.

Chemical separation systems look to use certain chemical reactivity to remove unwanted elements. These systems can use acidic conversion systems in combination with basic chemical conversion systems using caustic soda systems like sodium hydroxide to capture unwanted elements in materials. These systems can also involve using higher temperature and pressures that require reactor systems to process the material. These systems also require processing of intermediate products which pose environmental risks and problems. These systems also require milling and micronization to a level sufficient to expose the particles to the chemical extraction processes.

For example, for a chemical reduction of aluminum and silicon in a compound may involve using the Bayer process involving use of an acid wash such as hydrochloric acid and then a caustic soda NAOH wash to reduce the unwanted aluminum and silicon materials. To extract those elements the materials must be exposed and most materials need to be ground to very fine levels to expose the unwanted elements to the chemical extraction process. This process involves using expensive systems that can produce by-products that require special handling and may require specialized disposal or clean-up processes and disposal costs.

There exists a need in the art for an efficient means of extracting hard a particulate from a compound.

SUMMARY

From the foregoing discussion, it should be apparent that a need exists for a method, system and apparatus for separating harder elements from a compound. Beneficially, such a means would provide a multi-stage means of milling and separating harder particulate from a compound.

The present invention has been developed in response to the present state of the art, and in particular, in response to the problems and needs in the art that have not yet been fully solved by currently available inventions. Accordingly, the present invention has been developed to provide a method of separating hard contaminates from a micronized particulate, the steps of the method comprising: inputting unfiltered micronized particulate into a first jet mill; directing milled particulate output from the first jet mill into a first diverter valve; purging milled particulate using the first diverter valve which exceeds a first predetermined threshold; directing milled particulate output from the first valve which fails to exceed the first predetermined threshold into a second jet mill; directing milled particulate output from the second jet mill into a second diverter valve; purging milled particulate using the second diverter valve which exceeds a second predetermined threshold; directing milled particulate output from the second valve which fails to exceed the second predetermined threshold into a third jet mill; directing milled particulate output from the third jet mill into a third diverter valve; and purging milled particulate using the third diverter valve which exceeds a third predetermined threshold; directing milled particulate output from the third jet mill which fails to exceed a third predetermined threshold as processed material.

The second predetermined threshold maybe in some embodiments approximately two-thirds of the third predetermined threshold.

The method may further comprise directing milled particulate output from the third jet mill into classifier. The micronized particulate may be petroleum coke in some embodiments.

The micronized particulate may be subjected to de-ashing before input into the first jet mill.

The average mean diameter of the processed materials may be between 0.005 microns and 10 microns. The method may further comprise beginning the method anew by inputting purged milled particulate from the third diverter valve as unfiltered micronized particulate into the first jet mill.

A second method of separating hard contaminates from a micronized particulate is provided, the steps of the method comprising: inputting unfiltered particulate into a first jet mill; directing milled particulate output from the first jet mill into a first classifier; purging milled particulate using the first classifier which exceeds a first predetermined threshold; inputting milled particulate which fails to exceed a first predetermined threshold into a second jet mill; directing milled particulate output from the second jet mill into a second classifier; purging milled particulate using the second classifier which exceeds a first predetermined threshold; directing milled particulate output from the second classifier which fails to exceed a second predetermined threshold as processed material.

The micronized particulate may be petroleum coke. The micronized particulate may be subjected to de-ashing before input into the first jet mill. The average mean diameter of the processed materials between 0.005 microns and 10 microns. The method may further comprise beginning the method anew by inputting purged milled particulate from the second classifier as unfiltered micronized particulate into the first jet mill.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are provided. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

It is an objective of the present invention to provide a system, method, apparatus and means to reduce the concentration of particulate with a high hardness factor than the remainder of the material. This harder material when processed in a size reduction system in accordance with the present invention will beneficially reduce the size of softer particles faster than the hard particles. This preferential size reduction with respect to the softer preferential material create a substantial size reduction in particles of the element blend crating a mix of particle sizes that can be classified to preferentially remove the larger or denser particles that are harder abrasive material particles.

It is a further object of the present invention to reduce size of particles to such a level that the wear issues are removed from the use of the processed biomass in diesel engine systems with the prevalence of silicon and aluminum to below 80 PPM and calcium below 200 PPM by testing such material before final slurry preparation such that if the processing has not lowered the levels below the target reduction point the material will continue to be processed in steam jet mills and classified with extraction points and electrostatic separation to continue to reduce the unwanted material level to the 80 PPM point for the aluminum plus silicon and 200 ppm for calcium prior to the slurry step.

Figure 1:
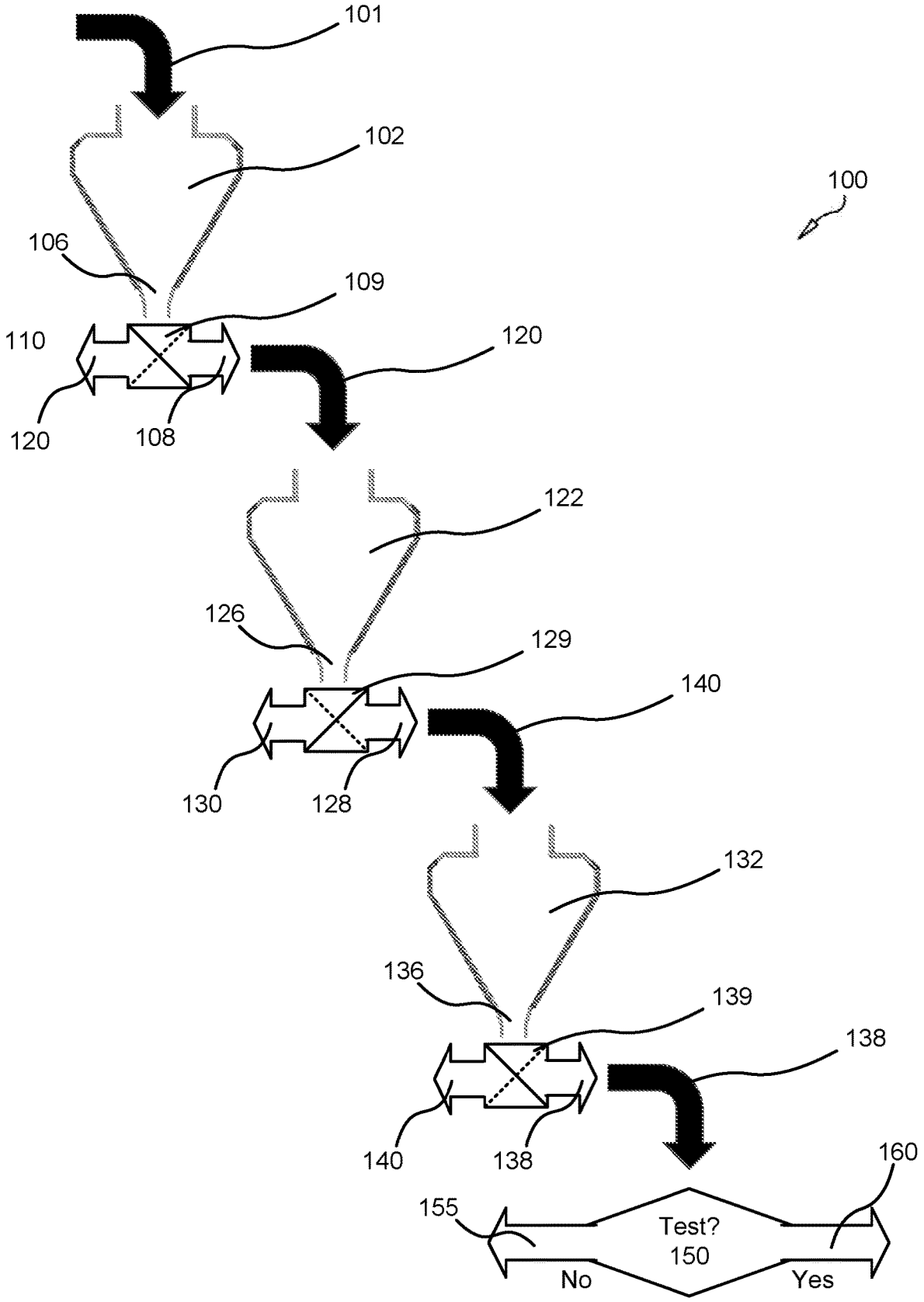
FIG. 1 sets forth a basic process flow diagram of a jet milling system with internal classification systems to which a purge cycle and valve system have been added in accordance with the present invention.

FIG. 1 sets forth a basic process flow diagram of a jet milling system 100 with internal classification systems to which a purge cycle and valve system have been added in accordance with the present invention.

This purge system is installed to direct larger particles that have not been milled to targeted set points that remain in the particle collision process out of the processing. The purge cycle will stop the material inflow to the system until the purge cycle has been finished. The output of one jet mill system that has met the internal classification system escape boundary during non-purge operating periods can be sent to a second jet mill with internal classification system set with a smaller particle set point than the first jet milling system internal classification set point. That system will operate as the first system did with a purge cycle for some set duration and with the material outflow from the non-purge period that has met the internal classification system set point can be directed to an additional jet mill system. That system will have an internal classification system set point again set to a smaller particle size and will again have a purge cycle system to remove particle that have remained in the particle collision process to remove harder larger particles. The output of the system from non-purge periods can H be directed to a testing system to identify if the compound material has met the desired particle separation criteria and if so the material can be sent to a storage location or directed into the process where it will be used.

Unfiltered particulate 101 (or unprocessed material 101) is input to the separation process indicated at 100 comprising a jet mill system with an internal classification system. That material 101 (or unfiltered particulate 101) is processed with an internal classifier having a predetermined size threshold (the "first set point") set at a size below the maximum size of those particles targeted for extraction. The material 101 is processed until falling under said set point then discharged as feed material 120 into another jet mill 122 in series. At a chosen interval a purge cycle is engaged to clear the jet mill 102 of material in the jet mill 102 processing compartment. When the purge cycle is engaged new material 101 is blocked from entering the mill 102 and the purge cycle diverter valve 109 is positioned to direct purge material 110 away out of the system 100. The diverter value 109 is shown in a non-purge position.

The material that flows from the initial jet mill internal classifier at 108 and into the second jet mill system at 120 will have a smaller particle size from the purge material 110. The second jet mill 122 has a second set point, or threshold, set below the first set point which, in some embodiments, is less than 50% of the difference between the first set point and the final targeted size of processed material 160 to be removed. That material 160 is directed out of the classification system 100 at 150. At a predetermined interval, a purge cycle is engaged to clear the jet mill 122 of material in the jet mill processing compartment in 122. When the purge cycle is engaged new material 120 is blocked from entering the mill 122 and the purge cycle diverter valve 129 is positioned to direct purge material 130 away. The diverter value 129 is shown in a purge position.

The material that flows from the second jet mill 122 internal classifier at 128, which material satisfies the second set point, is directed into the third jet mill 132 for H further particle size reduction. The third jet mill 132 has a third set point thresholded below the second set point. The jet mill 132 finalizing particle size reduction. Material 140 input into the jet mill 132 is processed by the jet mill 132 and directed out of the classification system at 138 as processed material 160. At a predetermined interval, a purge cycle is engaged to clear the jet mill 132 of material in the jet mill 132 processing compartment. When the purge cycle is engaged, new material is stopped from entering the mill at 130 and the purge cycle diverter valve 139 is position to direct purge material away. The diverter value 139 is shown in a non-purge position.

The processed material 160 existing the system 100 is the tested to see if a material removal criteria has been achieved. If the processed material 160 has not satisfied the material removal criteria, then additional milling with classification and purge cycles will need to occur 155. In some embodiments, the processed material is redirected into jet mill 102 for beginning the process anew or directed into an electrostatic classification system. If the processed material 160 satisfies the material removal criteria, then the processed material 160 will be directed to final processing into a product, such as a petroleum coke slurry, or directed to storage to await final product packaging or processing.

Contaminates removed include, inter alia, silica and aluminum-oxide.

Figure 2:
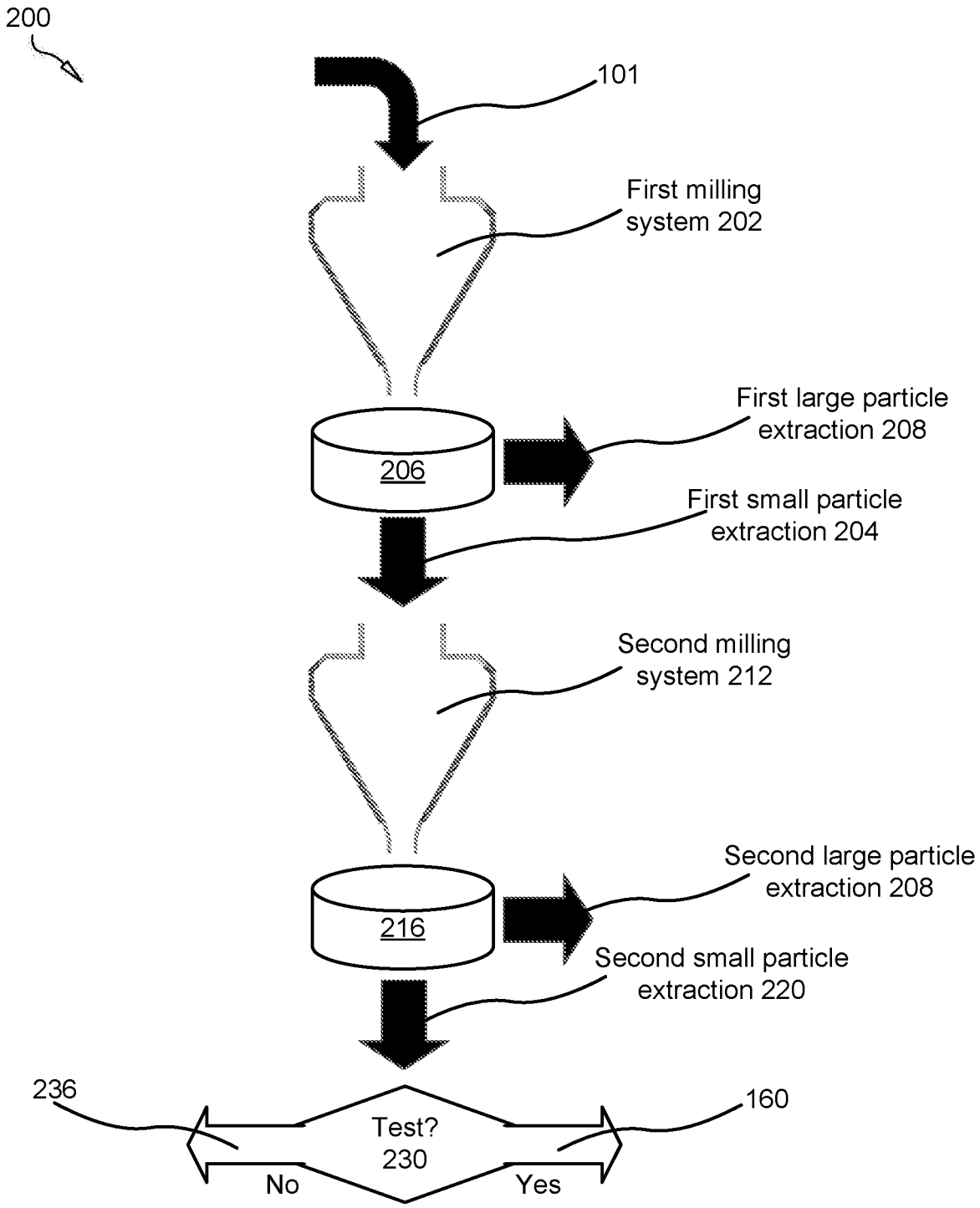
FIG. 2 sets forth a basic process flow diagram of a milling system with external particle classification system adapted to extract hard elements from a particulate in accordance with the present invention.

FIG. 2 sets forth a basic process flow diagram of a milling system 200 with external particle classification system adapted to extract hard elements from a particulate in accordance with the present invention.

The milling system 200 operates to achieve a particle size distribution target size for processed material 160. Subsequently a particle size classification system is used to separate out particulate exceeding a predetermined threshold from the processed material 160. The smaller milled material that has had larger size particles removed by way of the classification system is then be fed to another milling system that will be operated until a target particle size distribution has been achieved. That material will be separated with a particle classification systems at some desired set point once again. The material which has smaller particle sizes can be again fed to another milling system for size reduction to a smaller size distribution and classified again based on particle sizes at a chosen set point. The smaller particle sized material can be tested to see if the desired material removal level has been achieved if not additional milling and classification separation steps such as electrostatic separation can be added and if the material has met the desired criteria for the targeted compound then it can be sent to a storage location or directed into the process where it will be used.

Unprocessed material 101 is input to the system 200 for separating hard particles. That material 101 is processed with an internal classifier 206 having a first set point below the expected maximum size of naturally occurring particles. The first milled material from the first milling system 202 is directed into a classifier 206 having a second set point. Material satisfying the second set point is discharged as feed material 204 into a second milling system 212 in series. The larger particles 208 from the classifier 206 are directed out to storage or use.

Material is again milled in the milling system 212 using a smaller target distribution, or subject to a smaller second set point, than the first mill's 202 set point and fed either continuously or in a batch mode into another particle size classifier 216. The small particle material existing the system 200 is then tested to see if a material removal criteria has been satisfied at 230. If the material has not met the criteria, it becomes purged material 236 and additional downstream milling with classification and purge cycles will need to take place. If the material satisfied the material removal criteria then that material becomes processed material 160 and will be directed to final processing into a product or directed to storage to await final product packaging or processing.

In some embodiments, the particulate or material undergoing processing system 100 or system 200 comprises filtration prior to coking or de-salting petroleum coke subject to two or three stages pre-processing to increase reliability and obtain reduction in the unwanted metals (silicon and aluminum) content.

The final processed material 160 may comprise mean particle sizes of between 0.001 and 30 microns. In some embodiments of the present invention, the particle size does not exceed 2 microns. In still further embodiments, the processed material 160 is repeatedly re-micronized in response to the diameter of an average particle size exceeding a predetermined criterion. In some embodiments, the predetermined criterion is set by a human operator. In still further embodiments, the predetermined criterion is automatically determined by a computer analyzing historical data comprising one or more of horsepower output measurements of a specific set of one or more internal combustion engines.

Figure 3:
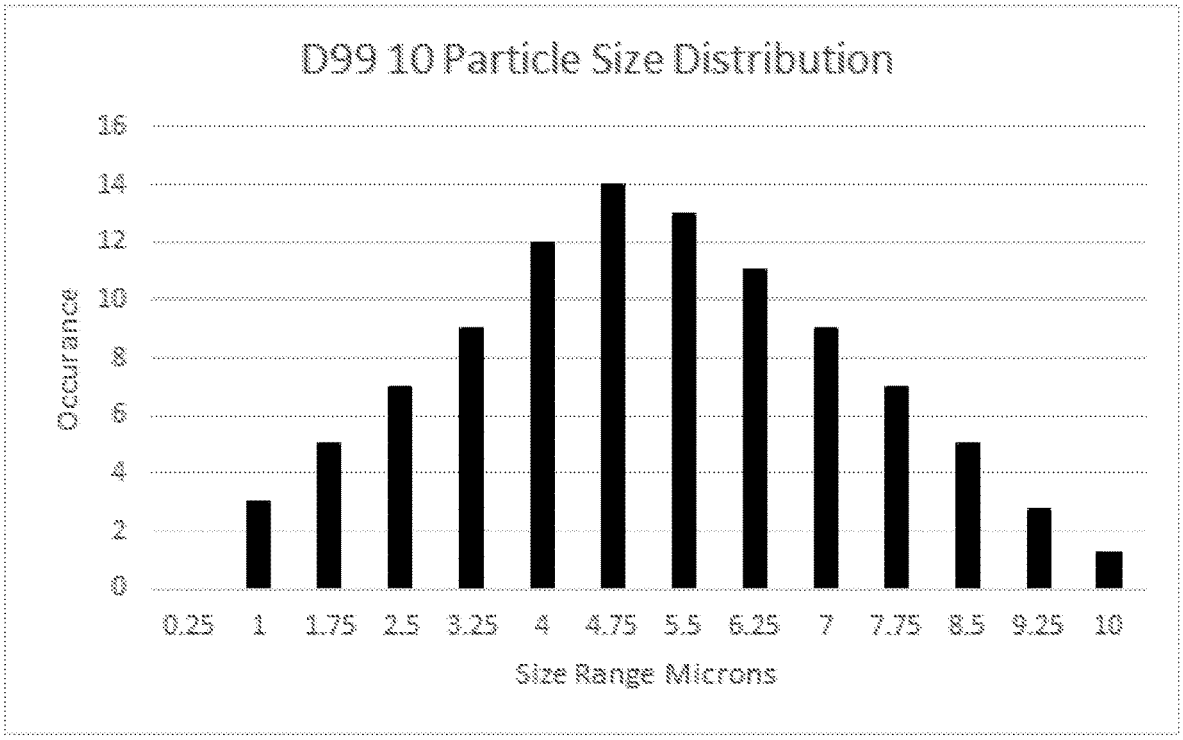
FIG. 3 sets forth a bar graph illustrating the occurrence in a compound of various sized particles by mean diameter in accordance with the present invention.

FIG. 3 sets forth a bar graph illustrating the particle distribution in a compound of various sized particles by mean diameter in accordance with the present invention.

That particle material is separated by classification (using a classifier, diverter valve, an electrostatic separation system, or other means known to those of skill in the art) as an example at a classification set point of 8.5 microns which in the example would separate out the largest 5% of the material which will contain a higher portion of the hard material to be separated away from the compound.

The 95% of the total particle material that is now at a smaller particle size material is then milled again until 99% of that material is smaller than 3.5 microns. The material is then classified such that the 3% of the largest particles in the material is removed with a target classification set point of 2.75 microns. That will leave 97% of the remaining material that will have less of the harder material by concentrate than will have been left in the 3% of the material that has been removed. That will mean that 8% of the total starting material will have been removed in this example.

Figure 4:
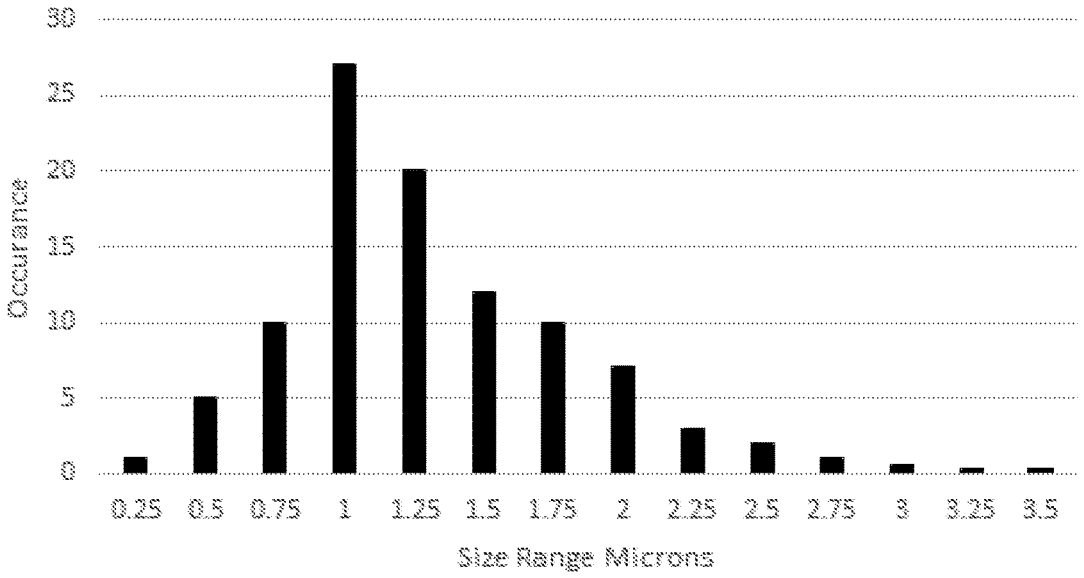
FIG. 4 sets forth a bar graph illustrating the occurrence in a compound of various sized particles by mean diameter in accordance with the present invention.

FIG. 4 sets forth a bar graph illustrating the particle distribution in a compound of various sized particles by mean diameter in accordance with the present H invention.

The 97% of the total particle material that is now at a smaller particle size material is then milled again until 99% of that material is smaller than 2.5 microns. The material is then classified such that the 2% of the largest particles in the material is removed with a target classification set point of 2.0 microns. That will leave 98% of the remaining material that will have less of the harder material that will have been left in the 2% of the material that has been removed. That will mean that 10% of the total starting material will have been removed by this third cycle in this example. Chart 3 shows the example particle distribution of that second milling process.

Figure 5:
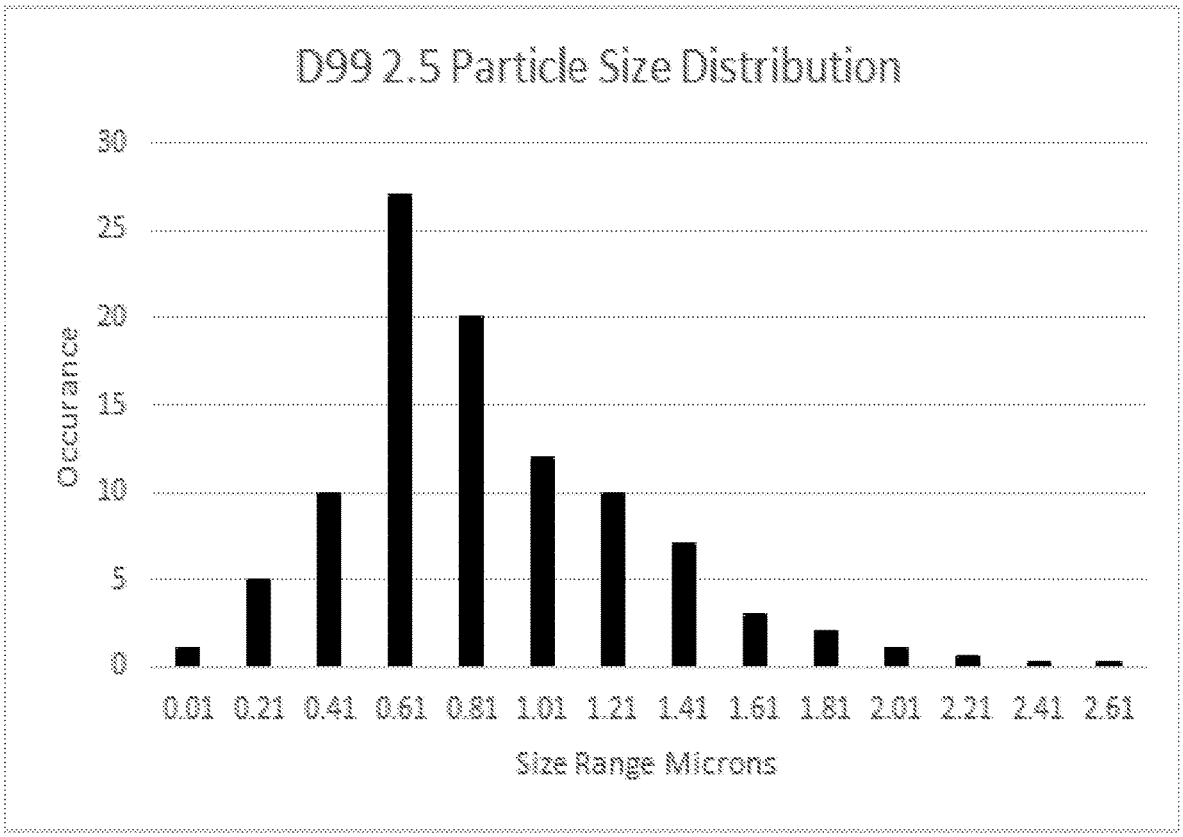
FIG. 5 sets forth a bar graph illustrating the occurrence in a compound of various sized particles by mean diameter in accordance with the present invention.

FIG. 5 sets forth a bar graph illustrating particle distribution in a compound of various sized particles by mean diameter in accordance with the present invention.

That material is then tested to determine if the particle separation target criteria has been achieved. Various material compounds that have various percentage components will have different optimal size distribution initial targets and will have different target size classification points for separating out the harder components from the compound. Such optimization for milling initial targets for the d99 point and the removal classification set points can be determined by looking at the extraction loss of material and its cost as well as degree of desired removal of the separated materials.

Figure 6:
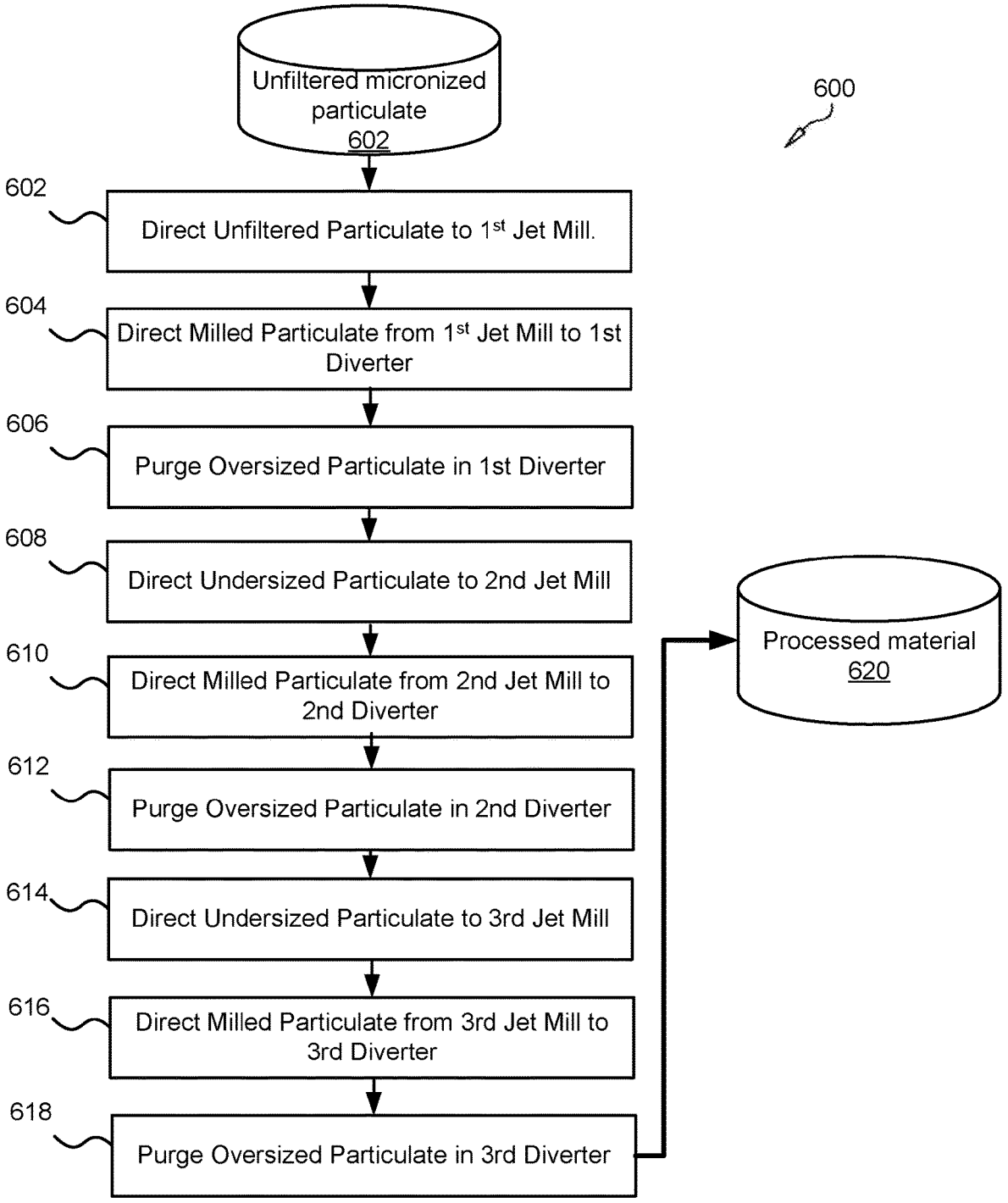
FIG. 6 illustrates one method of separating hard contaminates from a particulate in accordance with the present invention.

FIG. 6 illustrates one method 600 of separating hard contaminates from a particulate in accordance with the present invention.

The method 600 begins when unfiltered micronized particulate is directed 602 into a first jet mill. The unfiltered micronized particulate is directed 604 from the first jet mill to a first diverter and oversized milled particulate exceeding a first predetermined threshold is then purged from the first diverter. Undersized milled particulate is directed 608 to a second jet mill then redirected 610 after processing to a H second diverter. Milled particulate exceeding a second predetermined threshold is purged 612. Milled particulate failing to exceed a predetermined threshold is directed 614 to a third jet mill, then directed 616 to a third diverter. Milled particulate from the third diverter is purged 618 if oversized or otherwise enter final processing and becomes processed material.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of separating hard contaminates from a micronized particulate, the steps of the method comprising:

inputting unfiltered micronized particulate into a first jet mill;

directing milled particulate output from the first jet mill into a first diverter valve;

purging milled particulate using the first diverter valve which exceeds a first predetermined threshold;

directing milled particulate output from the first valve which fails to exceed the first predetermined threshold into a second jet mill;

directing milled particulate output from the second jet mill into a second diverter valve;

purging milled particulate using the second diverter valve which exceeds a second predetermined threshold;

directing milled particulate output from the second valve which fails to exceed the second predetermined threshold into a third jet mill;

directing milled particulate output from the third jet mill into a third diverter valve; and purging milled particulate using the third diverter valve which exceeds a third predetermined threshold;

directing milled particulate output from the third jet mill which fails to exceed a third predetermined threshold as processed material to an electrostatic separation system.

2. The method of claim 1, wherein the second predetermined threshold is approximately two-thirds of the third predetermined threshold.

3. The method of claim 2, further comprising reducing an average diameter of the unfiltered micronized particulate to mitigate wear caused by the use of the unfiltered micronized particulate in a diesel engine wherein a prevalence of silicon and aluminum is reduced to below 80 PPM and calcium to below 200 PPM.

4. The method of claim 1, further comprising directing milled particulate output from the third jet mill into classifier.

5. The method of claim 1, wherein the micronized particulate is petroleum coke.

6. The method of claim 1, wherein the micronized particulate is subjected to de-ashing before input into the first jet mill.

7. The method of claim 1, wherein the average mean diameter of the processed materials between 0.005 microns and 10 microns.

8. The method of claim 1, further comprising beginning the method anew by inputting purged milled particulate from the third diverter valve as unfiltered micronized particulate into the first jet mill.

9. A method of separating hard contaminates from a particulate, the steps of the method comprising:

inputting unfiltered micronized particulate into a first jet mill;

directing milled particulate output from the first jet mill into a first classifier;

purging milled particulate using the first classifier which exceeds a first predetermined threshold;

inputting milled particulate which fails to exceed a first predetermined threshold into a second jet mill;

directing milled particulate output from the second jet mill into a second classifier;

purging milled particulate using the second classifier which exceeds a first predetermined threshold; and directing milled particulate output from the second classifier which fails to exceed a second predetermined threshold as processed material to a further classification and separation step involving electrostatic separation.

10. The method of claim 8, further comprising:

testing said milled particulate to determine if the milled particulate fails to exceed a final predetermined threshold; and forwarding milled material for final product preparation.

11. The method of claim 8, wherein the micronized particulate is petroleum coke.

12. The method of claim 8, wherein the micronized particulate is subjected to de-ashing before input into the first jet mill.

13. The method of claim 8, wherein the average mean diameter of the processed materials between 0.005 microns and 10 microns.

14. The method of claim 8, further comprising beginning the method anew by inputting purged milled particulate from the second classifier as unfiltered micronized particulate into the first jet mill.

* * * * *